US006375527B2

(12) United States Patent
Gohara

(10) Patent No.: US 6,375,527 B2
(45) Date of Patent: Apr. 23, 2002

(54) VENTILATION SYSTEM FOR SMALL WATERCRAFT

(75) Inventor: Yoshihiro Gohara, Shizuoka (JP)

(73) Assignee: Yamaha Hatsudoki Kabushiki Kaisha (JP)

( * ) Notice: Subject to any disclaimer, the term of this patent is extended or adjusted under 35 U.S.C. 154(b) by 0 days.

(21) Appl. No.: 09/451,432

(22) Filed: Nov. 30, 1999

(30) Foreign Application Priority Data

Nov. 30, 1998 (JP) ..... 10-339860

(51) Int. Cl.[7] ..... B63H 21/32

(52) U.S. Cl. ..... 440/89; 114/55.5; 114/55.51; 114/55.53; 114/55.57; 114/211; 440/88

(58) Field of Search ..... 114/55.5, 55.51, 114/55.53, 55.57, 211, 363; 440/38, 88, 89

(56) References Cited

U.S. PATENT DOCUMENTS

| | | | | | |
|---|---|---|---|---|---|
| 4,678,442 | A | * | 7/1987 | Nishida et al. | 440/89 |
| 4,982,682 | A | | 1/1991 | Hattori | 114/55.5 |
| 4,984,528 | A | | 1/1991 | Kobayashi | 114/55.5 |
| 5,390,621 | A | | 2/1995 | Hattori et al. | 114/55.5 |
| 5,402,744 | A | * | 4/1995 | Matamoros | 114/55.5 |
| 5,490,474 | A | | 2/1996 | Ikeda | 114/343 |
| 5,664,515 | A | | 9/1997 | Hattori e al. | 114/211 |
| 5,752,867 | A | | 5/1998 | Koyanagi | 440/89 |
| 5,830,022 | A | * | 11/1998 | Nakase et al. | 440/88 |
| 5,839,930 | A | * | 11/1998 | Nanami et al. | 440/88 |
| 5,902,158 | A | | 5/1999 | Nakase et al. | 440/88 |
| 5,951,342 | A | | 9/1999 | Ozawa et al. | 440/88 |
| 5,951,343 | A | | 9/1999 | Nanami et al. | 440/88 |
| 5,954,555 | A | | 9/1999 | Ozawa et al. | 440/89 |
| 5,957,072 | A | | 9/1999 | Hattori | 114/55.57 |
| 6,010,378 | A | * | 1/2000 | Fujimoto et al. | 440/89 |
| 6,015,320 | A | * | 1/2000 | Nanami | 440/88 |
| 6,015,321 | A | | 1/2000 | Ozawa et al. | 440/89 |
| 6,019,648 | A | * | 2/2000 | Lecours et al. | 440/38 |
| 6,022,253 | A | | 2/2000 | Ozawa et al. | 440/89 |
| 6,077,135 | A | | 6/2000 | Ito | 440/83 |
| 6,089,932 | A | * | 7/2000 | Nanami et al. | 440/88 |
| 6,106,344 | A | * | 8/2000 | Mashiko | 440/89 |
| 6,135,832 | A | * | 10/2000 | Suzuki | 440/83 |
| 6,155,896 | A | * | 12/2000 | Suzuki | 440/89 |

* cited by examiner

*Primary Examiner*—S. Joseph Morano
*Assistant Examiner*—Lars A. Olson
(74) *Attorney, Agent, or Firm*—Knobbe, Martens, Olson & Bear, LLP

(57) ABSTRACT

A personal watercraft has an improved ventilation system for an engine compartment. The ventilation system is disclosed in the context of both two-cycle and four-cycle engines. The system includes a plurality of ducts that are strategically positioned on the watercraft. One of the ducts extends through a sidewall of a pedestal that carries an operator seat. Another of the ducts extends through a bottom plate connecting the seat to the hull. The ducts are configured to create airflow across various engine and exhaust system components. For instance, a portion of an exhaust system is interposed between two ends of two separate ducts in one arrangement. In another arrangement, a duct draws or forces air past a portion of the exhaust system. The portion of the exhaust system can include a catalyst. The system also creates a flow of air across a cylinder head in one arrangement and a lubricant reservoir in another arrangement.

42 Claims, 5 Drawing Sheets

VENTILATION SYSTEM FOR SMALL WATERCRAFT

PRIORITY INFORMATION

This application is based on and claims priority to Japanese Patent Application No. 10-339,860, filed Nov. 30, 1998.

FIELD OF THE INVENTION

The present invention generally relates to engine compartment ventilation systems for personal watercraft. More particularly, the present invention relates ventilation systems having air outlets strategically positioned within engine compartments of personal watercraft.

BACKGROUND OF THE INVENTION

As is well known, engines powered by internal combustion engines that are mounted inboard of the hull and within an engine compartment require adequate ventilation of the engine compartment. It is desirable to ensure that adequate air can reach the engine for combustion and also to purge the engine compartment from unwanted vapors. This problem, although easily handled with larger watercraft, presents a number of problems in conjunction with a smaller type of watercraft known as a "personal watercraft."

Personal watercraft are a relatively small type of watercraft wherein the rider sits more upon than in the watercraft. This type of watercraft is designed to be operated primarily by a single rider, although accommodations are frequently made for one or more passengers in addition to the operators. With this type of watercraft, the engine compartment is frequently formed below the rider's area or immediately forwardly of it.

This type of watercraft is quite sporting in nature and thus the rider and passengers frequently wear swimming suits when riding this type of watercraft. Thus, they expect to receive a fairly large amount of water spray during the watercraft operation. Because of this, there is a fair amount of water spray around the environment of the watercraft and this can easily enter the engine compartment through the ventilating system. Additionally, the watercraft can be easily overturned and at least partially submerged (and the occupants and users recognize that this is a distinct possibility) which further increases the risk of water intrusion. Of course, it is desirable to protect the engine and its auxiliaries from this water. Various arrangements have been proposed, therefore, for providing ventilation of the engine compartment while, at the same time, precluding water ingestion.

With the small type of watercraft involved, it is important to ensure adequate ventilating airflow but also to ensure that water will not enter the engine compartment through the ventilating system. Moreover, engine compartment temperature is also a prominent concern. For the reasons aforenoted, properly structuring a ventilation system that addresses each of these considerations is particularly difficult with personal-type watercraft.

SUMMARY OF THE INVENTION

It is, therefore, an object of the present invention to provide an improved engine compartment ventilating system for a personal watercraft. It is a further object of the present invention to provide a ventilating arrangement for a personal watercraft that will provide adequate ventilation and also will provide good assurance that water will not be inadvertently drawn into the engine compartment along with the ventilating air. Moreover, because engines operating in enclosed environments are prone to overheating without adequate air circulation about them, another object of the present invention is to direct cooling air flow to specific high temperature components to increase heat transfer away from the same components.

With this type of watercraft, the hull is generally made up of two major components, a lower hull under portion and an upper deck portion. The engine compartment is normally formed between these two hull portions and the two portions are generally sealed together to form an enclosed chamber. Because of this type of construction, it is relatively difficult to provide a good ventilating system that will achieve the aforenoted effects.

Accordingly, one aspect of the present invention involves a personal watercraft having a hull defining an engine compartment. An internal combustion engine is positioned in the engine compartment and a seat is positioned above at least a portion of the engine. A pedestal supports the seat. The watercraft includes a water propulsion device and the engine has an output shaft arranged to power the water propulsion device. At least one pedestal air duct, which is disposed on a sidewall of the pedestal, is in communication with the engine compartment. The duct has a first end extending through the pedestal, and a second end positioned within the engine compartment.

Another aspect of the present invention involves a personal watercraft comprising a hull defining an engine compartment. An internal combustion engine is mounted within the engine compartment and has a crankshaft. A lubrication system is associated with the engine and includes a lubricant reservoir that is in fluid communication with at least a portion of the engine. A seat is removably attached to the hull and is positioned above at least a portion of the engine. A ventilation duct extends between an exterior of the watercraft and the engine compartment. The ventilation duct has an end disposed within the engine compartment proximate a portion of the engine to which the lubricant reservoir is attached. The end of the ventilation duct is oriented in the engine compartment to direct a flow of ventilating air toward the portion of the engine supporting the lubricant reservoir.

BRIEF DESCRIPTION OF THE DRAWINGS

These and other features, aspects and advantages of the present invention now will be described with reference to the drawings of preferred arrangements, which arrangements are intended to illustrate and not to limit the present invention, and in which drawings.

DETAILED DESCRIPTION OF THE PREFERRED EMBODIMENTS OF THE INVENTION

The present invention generally relates to ventilation systems for engine compartments of personal watercraft. The ventilation systems are described in conjunction with an engine powering a personal watercraft because this is an application for which the arrangement has particular utility. Those of ordinary skill in the relevant arts will readily appreciate that the arrangements described herein also may have utility in a wide variety of other settings.

Figure 1:
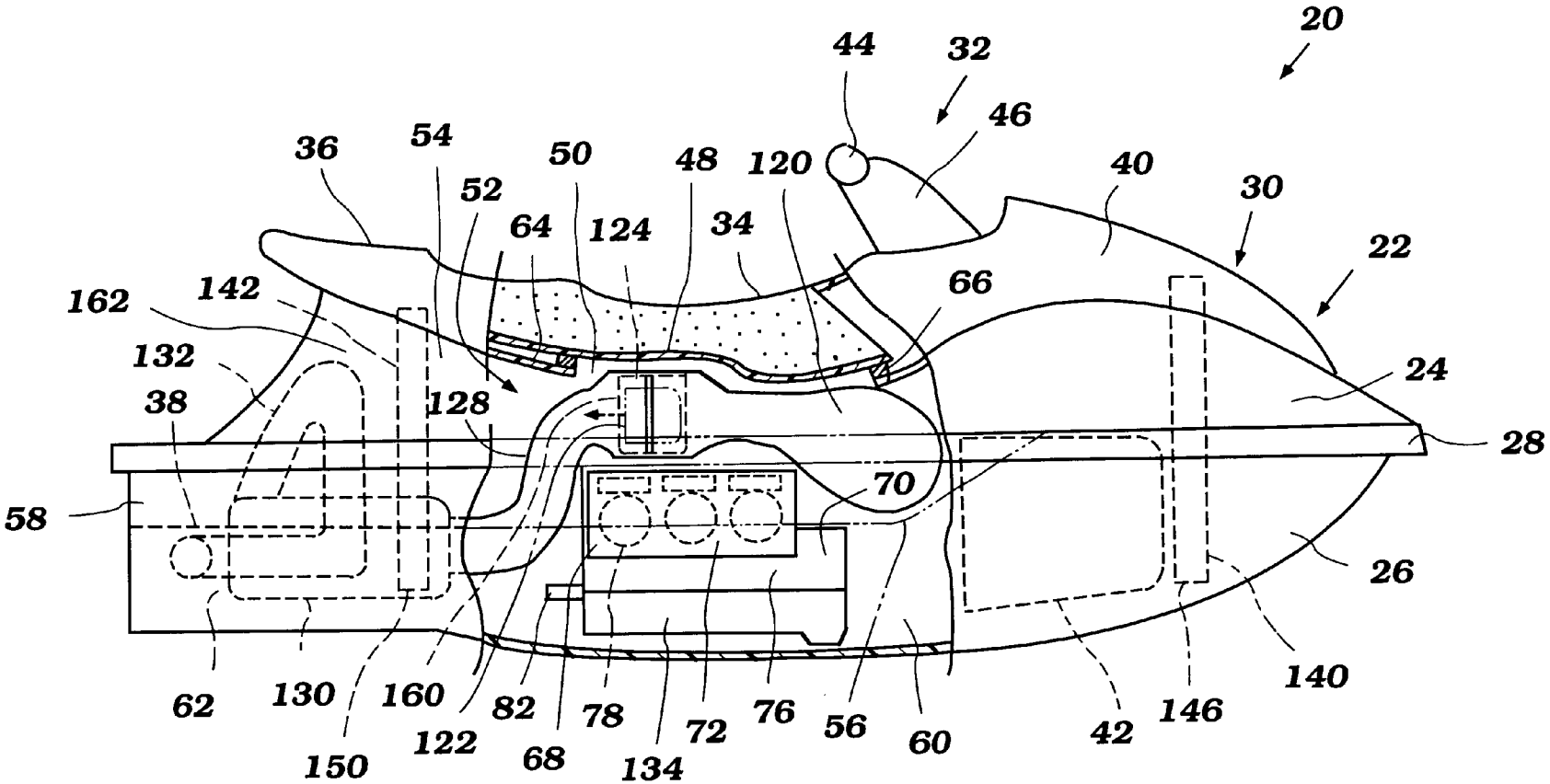
FIG. 1 is a partially sectioned side view of a personal watercraft having a ventilation system arranged in accordance with certain features, aspects and advantages of the present invention, the engine and other watercraft components positioned within a hull of the watercraft are illustrated in phantom.
Figure 2:
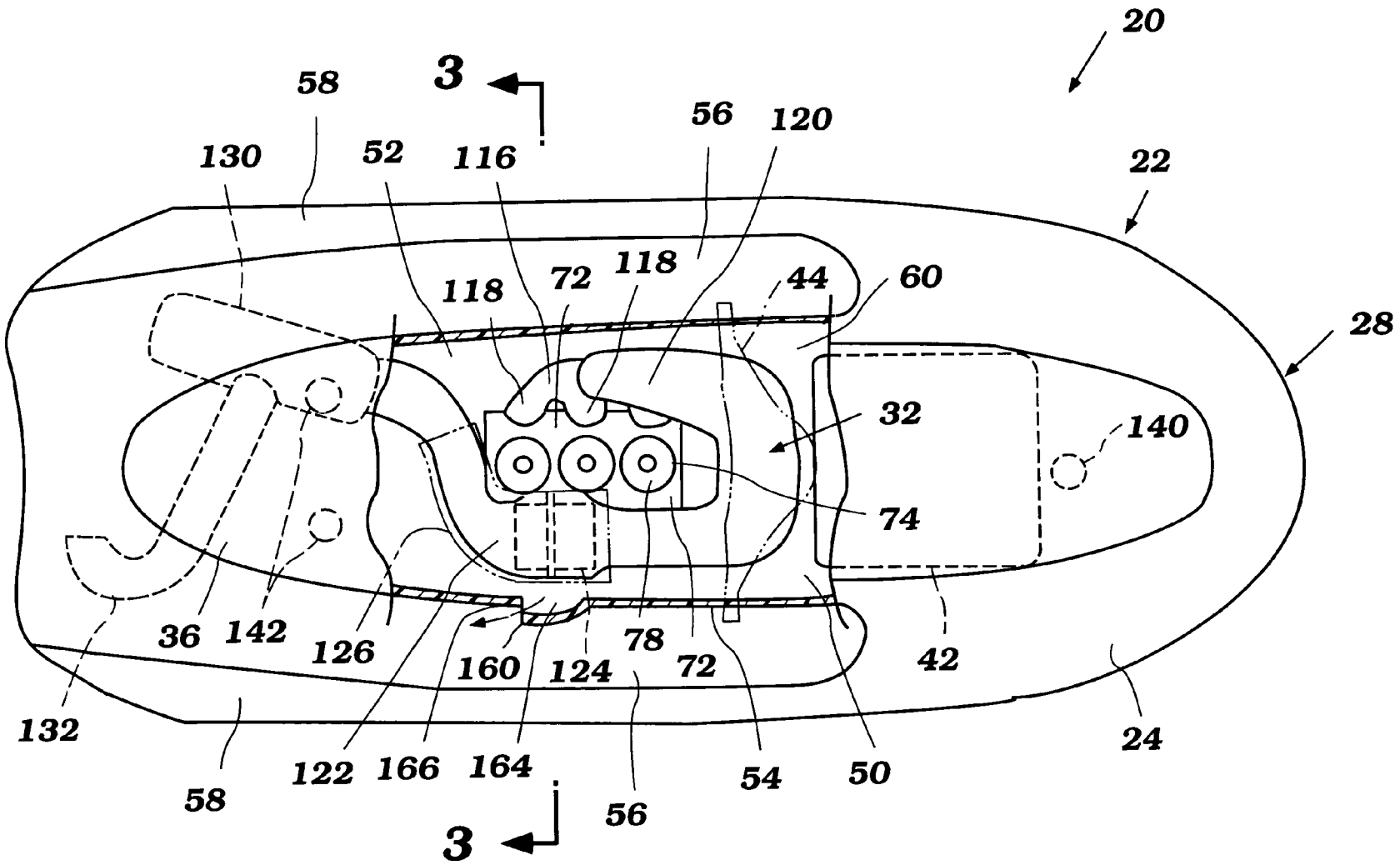
FIG. 2 is a partially sectioned top view of the watercraft illustrated in FIG. 1, with the engine and other watercraft components positioned within the watercraft illustrated in phantom.

With reference now to FIGS. 1 and 2, a personal watercraft, which is indicated generally by the reference numeral 20, is illustrated therein. The watercraft 20 includes a hull 22 that is defined by a top portion or deck 24 and a lower portion 26. These portions of the hull 22 are preferably formed from a suitable material such as, for example, a molded fiberglass reinforced resin. For instance, the deck 24 can be formed using a sheet molding compound (SMC), i.e., a mixed mass of reinforced fiber and thermal setting resin, that is processed in a pressurized, closed mold. The molding process desirably is temperature controlled such that the mold is heated and cooled during the molding process. For this purpose, male and female portions of the mold can include fluid jackets through which steam and cooling water can be run to heat and cool the mold during the manufacturing process.

The lower hull portion 26 and the upper deck 24 are joined around the peripheral edge at a bond flange 28. Thus, the bond flange 28 generally defines the intersection of the lower portion 26 of the hull 22 and the deck 24.

As viewed in a direction from the bow to the stern of the watercraft 20, the upper deck portion 24 includes a bow portion 30, a control mast 32, a front seat 34, a rear seat 36 and a boarding platform 38. The bow portion 30 preferably slopes upwardly toward the control mast 32. A hatch cover 40 can be provided within the bow portion 30. The hatch cover 40 preferably is pivotably attached to the upper deck 24 and is capable of being selectively locked in a closed and substantially watertight position. The hatch cover 40 can cover a storage compartment or can be used to cover a fuel tank 42 such as that illustrated in FIG. 1.

The control mast 32 extends upward from the bow portion 30 and supports a handlebar assembly 44. The handlebar assembly 44 controls the steering of the watercraft 20 in a conventional manner. The handlebar assembly 44 also carries a variety of the controls of the watercraft, such as, for example, a throttle control, a start switch and a lanyard switch. The handlebar assembly 44 is preferably enclosed by a handlebar cover 46 and desirably is mounted for pivotal movement forward of the front seat 34.

The front 34 and rear seats 36 are desirably of the straddle-type. A straddle-type seat is well known as a longitudinally extending seat configured such that operators and passengers sit on the seat with a leg positioned to either side of the seat. Thus, an operator and at least one passenger can sit in tandem on the seats 34, 36. Moreover, these seats 34, 36 are preferably centrally located between the sides of the hull 22. The front seat 34 is preferably positioned on a bottom plate 48 that covers an access opening 50 that allows access into a cavity 52 defined by the hull 22. Of course, the two seats 34, 36 can be combined in some arrangements into a single seat mounted to the watercraft by a single bottom plate or the like.

Figure 3:
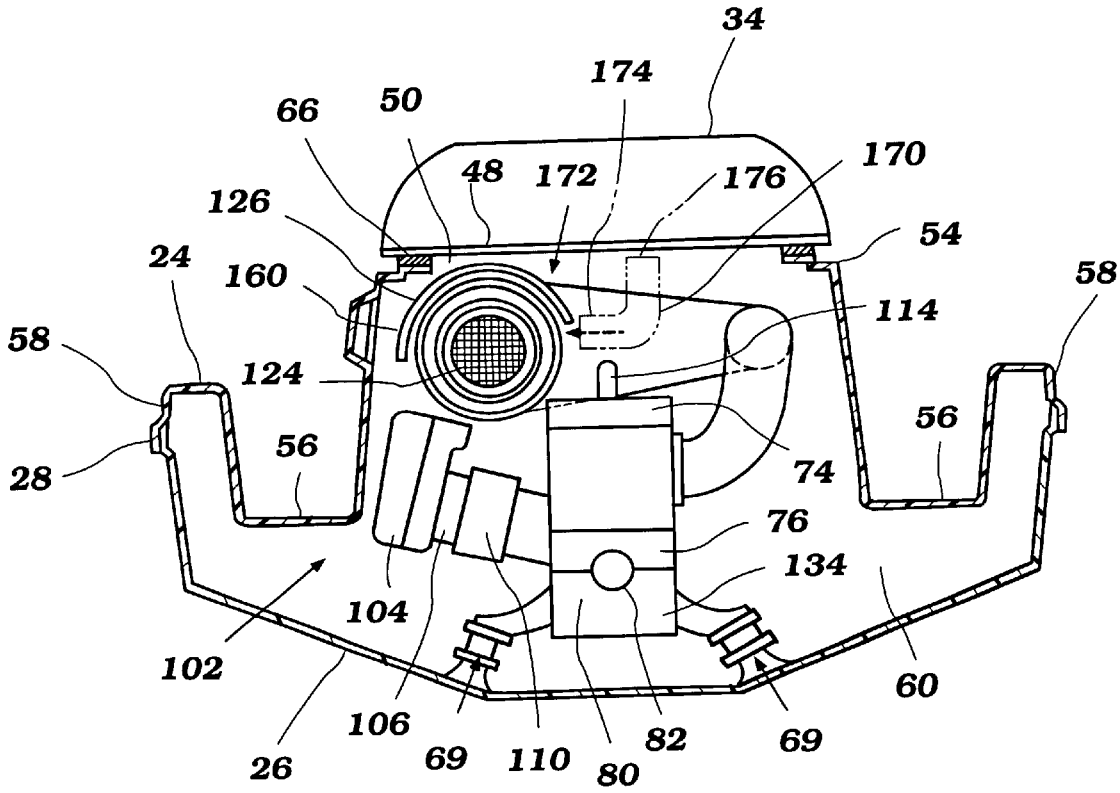
FIG. 3 is a cross-sectional end view of the watercraft illustrated in FIG. 1, taken along the line 3—3 in FIG. 2.

With continued reference to FIGS. 1 and 2, the upper deck 24 further comprises a longitudinally extending seat pedestal 54. The pedestal 54 supports the front seat 34 and the rear seat 36 in the illustrated arrangement. Foot areas 56 are formed alongside the pedestal 54 and are generally defined as the lower area located between the pedestal 54 and a pair of raised side gunwales or bulwarks 58 that extend along the outer sides of the watercraft 20. As best illustrated in FIG. 3, the foot areas 56 preferably are sized and configured to accommodate the lower legs and feet of the riders who straddle the seats 34, 36. As described above, the illustrated watercraft 20 also includes the boarding platform 38 that is connected to the illustrated foot areas 56 and that is formed at the rear of the watercraft 20 behind the pedestal 54. The boarding platform 38 allows ease of entry onto the watercraft 20.

Within the watercraft 20, the cavity 52 formed between the two hull sections 24, 26 is divided by one or more bulkheads (not shown). In the illustrated watercraft 20, a bulkhead (not shown) preferably is disposed within the hull cavity 52 to divide the cavity 52 into an engine compartment 60 and a pump chamber 62. As will be described, air ducts extend into the cavity to ventilate the cavity and to cool various components of the watercraft.

As described above, the access opening 50 is formed on a top surface 64 of the pedestal 54 and is desirably positioned beneath at least one of the seats 34, 36. Thus, the access opening 50, or maintenance opening, is covered by the bottom plate 48 of the seat 34 in a water-sealing manner. For this purpose, one or more seals 66, or gaskets, can circumscribe the opening 50. As illustrated, the engine compartment 60 can be accessed by removing the bottom plate 48 to reveal the maintenance opening 50.

An in-line, three cylinder, two-cycle engine 68 is mounted within the engine compartment 60 of the illustrated watercraft 20 using resilient mounts 69 as is well known to those of ordinary skill in the art. While the illustrated engine 68 is of the two-cycle variety, the engine 68 can also be of the four-cycle or rotary variety as well. Moreover, the engine 68 can have one, two or more than three cylinders and can be inclined, or formed with two banks of cylinders.

The general construction of a two-cycle engine is well known to those of ordinary skill in the art. As illustrated in FIGS. 1 through 3, the engine 68 generally comprises a cylinder block 70, a cylinder head 72, a cylinder head cover 74 and a crankcase 76. A set of cylinders 78 is formed within the cylinder block 70. The cylinders 78 are capped by the cylinder head 72 and cylinder head cover 74. A piston (not shown) is reciprocally mounted within each of the cylinders 78 and a combustion chamber (not shown) is defined within the cylinder 78 by the top of the piston (not shown), the wall of the cylinder and a recess (not shown) formed within a lower surface (not shown) of the cylinder head 72.

The crankcase 76 is attached to the opposite end of the cylinder block 70 from the cylinder head 72. A crankcase chamber 80 generally is defined by the crankcase 76 and the cylinder block 70. The crankcase chamber 80 preferably is subdivided by webs (not shown) or walls into separate chambers (not shown) corresponding to each of the cylinders 78. A crankshaft 82 is positioned within the crankcase 80 and is connected to the pistons (not shown) through a set of connecting rods (not shown). As the pistons (not shown)

reciprocate within the cylinders 78, the crankshaft 82 is rotated within the crankcase chamber 80.

Figure 4:
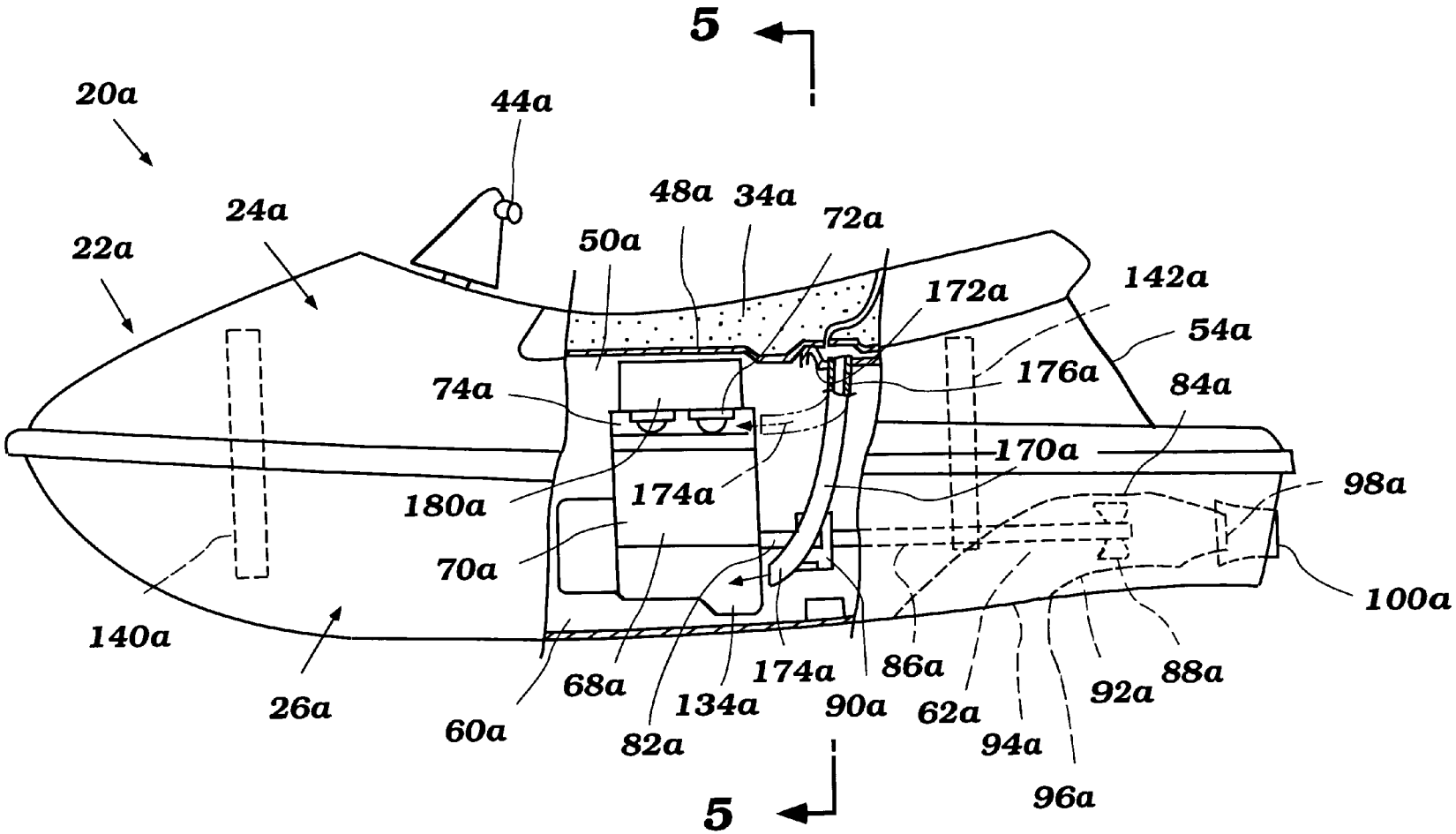
FIG. 4 is a partially sectioned side view of another personal watercraft having an additional ventilation system arranged in accordance with certain features, aspects and advantages of the present invention, the engine and other watercraft components positioned within a hull of the watercraft are illustrated in phantom.

A portion of the propulsion system will be described with reference to the arrangement of FIG. 4. With reference to FIG. 4, the crankshaft 82*a* preferably is in driving relation with a jet propulsion unit 84*a* (see FIG. 4) that is provided in the pump chamber 62*a*. Specifically, the jet propulsion unit 84*a* preferably includes an impeller shaft 86*a* to which a propeller or an impeller 88*a* is attached. The crankshaft 82*a* and the impeller shaft 86*a* desirably are connected through a conventional shock-absorbing coupling 90*a*. The impeller shaft 86*a* extends in the longitudinal direction and extends through a propulsion duct 92*a* that has a water inlet port 94*a* positioned on a lower surface of the hull 22*a*. The lower portion 26*a* of the hull 22*a* also includes an opening 96*a* in the stem of the watercraft in which a jet outlet port 98*a* of the propulsion unit 84*a* is positioned. The propulsion unit 84*a* generates the propulsive force by applying a pressure to water drawn up from the water inlet port 94*a* by rotating the impeller shaft 86*a* and by forcing the pressurized water through the jet outlet port 98*a* in a manner well known to those of ordinary skill in the art. Of course, this construction can be used in the arrangement of FIGS. 1–3 as well.

A nozzle deflector 100*a* or steering nozzle is connected to the jet outlet port 98*a* of the propulsion unit 84*a*. The nozzle deflector 100*a* desirably moves in the left/right and vertical directions via a well known gimbal mechanism. The nozzle deflector 100*a* is connected to the handlebar assembly 44*a* through a steering mechanism and a trim mechanism (not shown), whereby the steering and trim angles can be changed by the operation of the handlebar assembly 44*a* and associated trim controls.

As best illustrated in FIG. 3, the engine 68 also includes an induction system 102 that provides air to each combustion chamber (not shown) for combustion. Air within the engine compartment 60 is supplied to the engine 68 through the air intake system. A replenishable air supply is provided to the engine compartment 60 in manners that will be described in greater detail below.

Preferably, the air intake system includes an intake box 104 or silencer into which air from within the engine compartment 60 is drawn. The air is then delivered to a passage 106 through a throttle body (not shown). Within the throttle body (not shown), fuel is mixed with the air in the illustrated watercraft 20.

With reference to FIG. 1, fuel is drawn from the fuel tank 42 positioned within the cavity 52 defined by the hull 22. Conventional means, such as straps (not shown) secure the fuel tank 42 in position along the lower hull portion 26. The fuel is supplied from the fuel tank 42 to a charge former 110 through any suitable fuel pumping arrangement. The charge formers 110 can be carburetors or fuel injectors depending upon the application. The arrangement illustrated in FIG. 1, however, is carbureted.

The carburetors 110 vaporize and mix fuel with the intake air and regulate this fuel/air mixture using butterfly-type throttle valves (not shown) in a manner well known to those of ordinary skill in the art. The throttle valves (not shown) are preferably controlled by the throttle control (not shown) located at the steering handlebar assembly 44.

The air that passes beyond the throttle valve (not shown) then selectively passes through an intake port (not shown) into the crankcase chamber 80 as controlled by a reed valve (not shown) in any suitable manner. As discussed above, the crankcase chamber 80 is compartmentalized into separate smaller crankcase subchambers, one smaller subchamber each corresponding to each cylinder 78. As is also well known to those of ordinary skill in the art, the intake port (not shown) and the corresponding reed valve (not shown) are preferably provided corresponding to each cylinder 78.

In this arrangement, air delivered to a particular crankcase subchamber is partially compressed by the downward movement of the piston (not shown) corresponding to that crankcase subchamber (not shown). This air is then delivered from the crankcase subchamber (not shown) to the cylinder 78 through one or more scavenge passages (not shown). When the piston (not shown) moves upwardly, air is drawn through the reed valve (not shown) into the crankcase subchamber to supply the next air charge.

A suitable ignition system is provided for igniting the air and fuel mixture in each combustion chamber (not shown). Preferably, this system comprises a spark plug 114 corresponding to each cylinder 78. The spark plugs 114 are preferably fired by a suitable ignition system as well known to those of skill in the art.

Exhaust gas generated by the engine 68 is routed from the engine 68 to a point external to the watercraft 20 by an exhaust system which includes an exhaust passage (not shown) leading from each combustion chamber (not shown) through the cylinder block An exhaust manifold 116 or pipe is connected to a side of the engine 68. As best illustrated in FIG. 3, the exhaust manifold 116 is connected to one side of the engine 68 while the intake system of the engine 68 is connected to the opposite side of the engine 68.

The manifold 116 has a set of branches 118 each having a passage that corresponds to one of the exhaust passages leading from the combustion chambers (not shown). The branches 118 of the manifold 116 merge at a merge pipe portion 120 of the manifold 116, which extends in a generally forward direction. The merge pipe portion 120 has a further passage through which the exhaust is routed.

An expansion pipe 122 is connected to the exhaust manifold 116, preferably via a flexible member (not shown), such as a rubber sleeve. The expansion pipe 122 has an enlarged passage or chamber through which exhaust flows from the passage in the exhaust manifold 116. As illustrated, the expansion pipe 122 extends from its connection to the manifold 116 near the front end of the engine 68 around the opposite side of the engine 68 (i.e. to the side at which the intake system extends). A middle section of the expansion pipe 122 extends along the side of the engine 68 towards its rear end. As best illustrated in FIG. 3, the expansion pipe 122 is spaced from the intake.

A catalyst 124 preferably is positioned within the expansion pipe 122. Moreover, in the illustrated watercraft 20 a sound deadening protective cover 126 encases a portion of the expansion pipe to reduce noise. The cover 126 can also be designed to be thermally insulating such that the exhaust components that have reached an elevated temperature are not readily accessed through the access opening.

After flowing through the expansion pipe 122, the exhaust flows into an upper exhaust pipe section 128 of the exhaust system (see FIG. 1). This portion of the exhaust system leads to a water lock 130. The upper exhaust pipe 128 is preferably connected to the water lock 130 via a flexible fitting (not shown), such as a rubber sleeve. The exhaust flows through the water lock 130, which is preferably arranged in a manner well known to those of ordinary skill in the art, to prevent the backflow of water through the exhaust system to the engine 68. The exhaust then passes to a lower exhaust pipe 132, which has its terminus in the water near the stem of the watercraft 20. In this manner, exhaust flows from the engine 68 through the exhaust system to its discharge within the water.

The engine 68 can include a suitable lubricating system for providing lubricating oil to the various moving parts thereof and for injection with the fuel. Specifically, a lubrication reservoir 134 can be provided within the engine compartment. In some arrangements, the lubrication reservoir 134 is formed as an oil pan while in certain dry sump arrangements, the lubrication reservoir 134 may include a separate oil supply tank. Thus, the lubrication reservoir 134 can be positioned below or to one side of the engine 68 in some configurations.

In addition, the engine 68 can include a suitable liquid and/or air cooling system. Moreover, the watercraft 20 can include a bilge system for drawing water from within the hull cavity 52 and discharging it into the body of water.

Preferably, air is drawn into the engine compartment 60 through several air ducts. As illustrated, a forward air duct 140 is positioned in front of the engine 68 near the front end of the watercraft 20, and a plurality of aft air ducts 142 are positioned behind the engine 68 towards the stem of the watercraft 20. As will be recognized, the number of ducts 140, 142 is not critical and can be varied as desired depending upon the application. The outer end of any duct that extends through the hull 22 away from the hull cavity 52 is considered the inlet end while the other end of the duct that is positioned within the hull cavity 52 is considered the outlet end. Of course, as used herein, inlet and outlet are used for convenience and it will be recognized that, depending upon the particular operating conditions, the flow of air through the ducts can be in either direction or in both directions.

Due to the strategic locations of the forward duct 140 and the aft ducts 142 in general, an air current can be set up within the engine compartment 60 to induce a flow of air across at least a portion of the engine 68. In addition, as illustrated in FIGS. 1 and 3, the outlet ends of the ducts (146 and 150 respectively) are positioned proximate the lower hull portion 26 of the hull 22 such that the air flow is more likely to pass along a lower surface of the engine 68. In this position, the airflow can help cool the oil pan 134 and any lubricant pooling within the oil pan 134 during operation. As is known, as the lubricant passes through the engine components, the lubricant increases in temperature. The increase in lubricant temperature can decrease the effectiveness of the lubricant as well as accelerate the deterioration of the lubricant. Thus, cooling the lubricant can prolong the life of both the lubricant and the engine.

With reference now to FIGS. 1 and 2, a pedestal duct 160 is formed through a side wall 162 of the seat pedestal 54 in a location that is generally vertically lower than the seat 34. The duct 160, however, could extend through a forward-facing or rearward-facing portion of a seat pedestal in certain applications. The duct 160 defines a further passage leading through a portion of the hull 22 to a first end 164 positioned in the hull cavity 52. More specifically, the outlet 164 is preferably positioned within the engine compartment 60. So arranged, air flows from inside of the hull cavity 52 from the engine compartment 60 in a region proximate to the expansion chamber 122. Because the catalyst 124 is often positioned within the expansion chamber 122, this portion of the exhaust system is often maintained at an elevated temperature. Of course, the elevated temperature leads to heating of neighboring components as well as to general heating of the air within the engine compartment 60. Accordingly, air passes through the first end 164 of the pedestal duct 160 (which is positioned within the engine compartment 60), flows through a labyrinth (not shown) designed to trap water and water mists, and flows out of the hull cavity 52 through a second end 166 that extends through the surface of the hull.

The second end 166 is preferably raised to allow air rushing past the end to help create a suction over the second end 166 that draws air through the duct 160. As illustrated, the positioning of the pedestal duct also takes advantage of the principal that hot air rises to help exhaust the heated air from the engine compartment. Removing some of the heated air also helps to maintain the temperature of the catalyst 124. Because the duct is positioned proximate the operator of the watercraft, the sound shield or cover 126 over this portion of the exhaust system helps to reduce the noise level experienced by the operator.

With reference now to FIG. 3, a further upper air duct, a seat duct 170, also is provided to further cool the expansion chamber portion of the exhaust system. The seat duct 170 desirably extends from a recess 172 formed below a portion of the seat 34, 36. Of course, the seat duct can also extend from an insert piece positioned below either the front seat 34 or the rear seat 36 in other arrangements. The insert piece in such configurations preferably will include a ventilation mechanism that vents air in either direction. The duct 170 transfers cooler air from beneath the seat 34, 36 to a location inside of the hull cavity 52. Again, because the recess 172 formed below the seat 34, 36 is filled with a volume of substantially cooler air, the cooler air tends to be drawn into the engine compartment. Of course, as discussed above, the air can also flow out or in two directions within the duct 170.

As illustrated in FIG. 3, the air is routed through the seat duct 170 to a first end 174 located near the expansion chamber 122 from a second end 176 positioned in the seat recess 172. Thus, a cross flow from the seat duct 170 to the pedestal duct 160 can be established to continually replenish the engine compartment 60, or the cavity 52, with a cooler air supply.

Each of the air ducts is advantageously positioned to decrease the length of the ducting. By decreasing the length of the ducting, the impact of engine compartment heat upon the temperature of the cooling and ventilating air being supplied through the ducts can be reduced. Thus, each air duct desirably is strategically positioned with respect to its external and internal openings.

Figure 5:
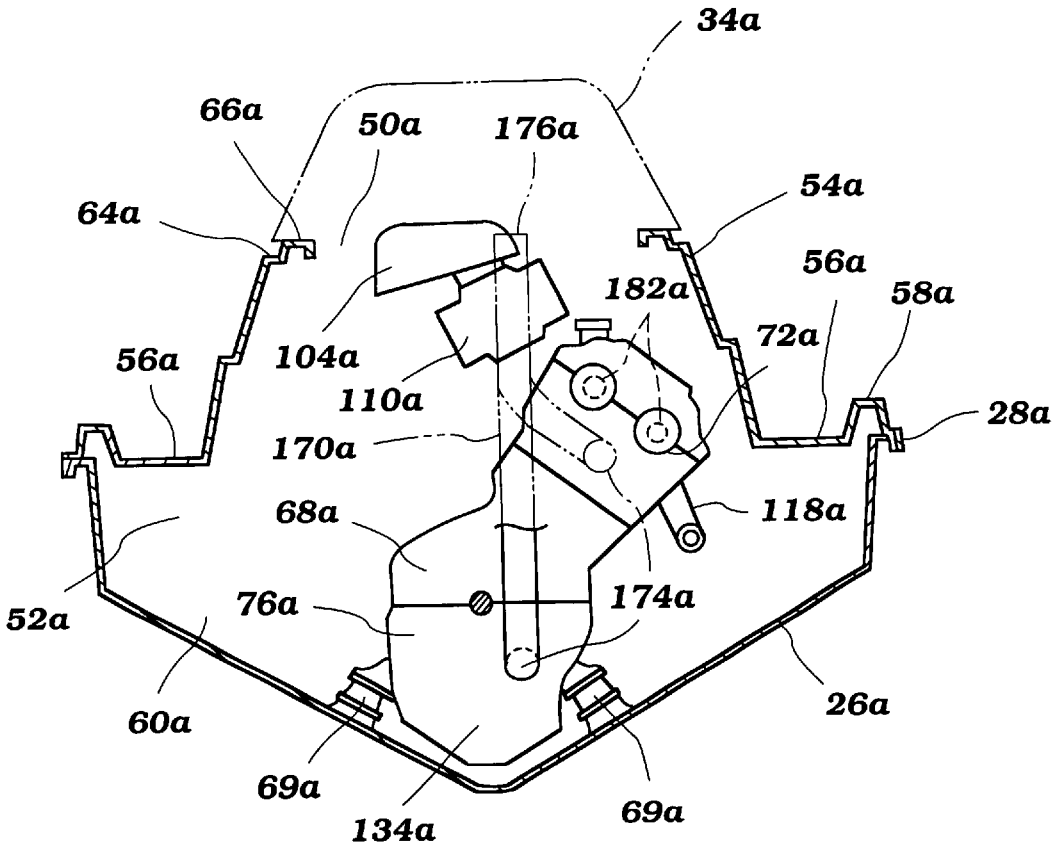
FIG. 5 is a cross sectional end view of the watercraft illustrated in FIG. 1, taken along the line 5—5 in FIG. 4.

A second ventilation arrangement configured in accordance with certain features, aspects and advantages of the present invention is illustrated in FIGS. 4 and 5. In the description and illustration of this arrangement, like or similar parts have been given the same reference numerals as those used in the description and illustration of the previous embodiment, except that an "a" designator has been added to all the reference numerals used herein. In general, unless otherwise indicated or recognized by those of ordinary skill in the art, the above-description also applies to the second arrangement.

The engine 68*a* of the watercraft in FIGS. 4 and 5 is a preferably four-cycle engine. This is evidenced by the positioning of a set of induction pipes 180*a* that extend into the cylinder head 72*a* and the use of a set of overhead cam shafts 182*a* to control both intake and exhaust valves (not shown). An oil pan 134*a* is positioned below the cylinder block 70*a* of the engine 68*a* while a cylinder head and cylinder head cover 74*a*, which at least partially defines the combustion chamber, are positioned above the cylinder block 70*a* in the engine 68*a*.

As with the first ventilation arrangement, a set of forward and aft ventilation ducts 140*a*, 142*a* are provided. Additionally, at least one seat duct 170*a* is also provided. As discussed above, the seat duct(s) 170*a* extend from a recess 172*a* formed beneath the seat 34*a* into strategic positions within the engine compartment 60*a*. Preferably, the seat ducts 170*a* have a first end 174*a* positioned proximate a highly heated component or components. In some arrangements, the first ends 174*a* are positioned next to components circulating liquids, such as lubricants or coolants. With reference to FIG. 4, the first ends 174*a* of the illustrated seat ducts 170*a* are positioned proximate an aft portion of the oil pan 134*a* and proximate an aft portion of the cylinder head 72*a*. In these positions, the seat ducts 170*a* can transmit cooler air to the high temperature components to help reduce the operating temperature of the components.

Additionally, as with the first arrangement, the positioning of the each of ducts is preferably designed to reduce the length of ducting. Thus, the length of time the ventilating air is within the ducting is reduced and the overall manufacturing cost of the watercraft can be decreased.

Figure 6:
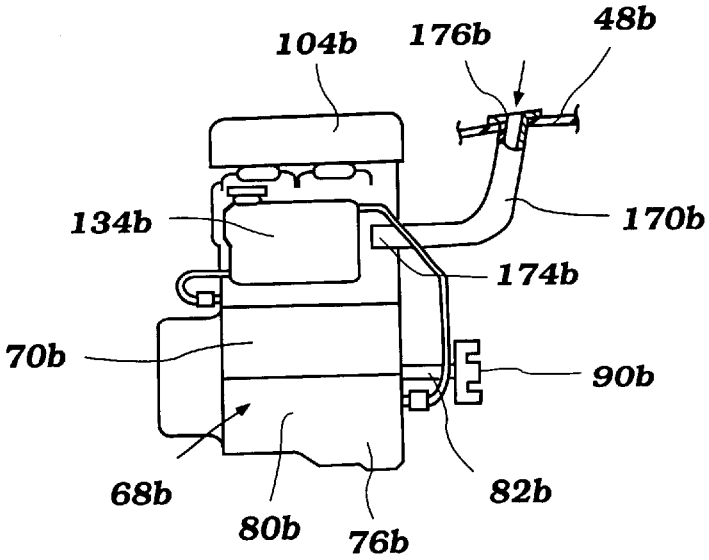
FIG. 6 is a side view of an additional engine and ventilation duct arrangement having certain features, aspects and advantages in accordance with the present invention.

A further ventilation arrangement configured in accordance with certain features, aspects and advantages of the present invention is illustrated in FIG. 6. In the description and illustrations of this arrangement, like or similar parts have been given the same reference numerals as those used in the description and illustration of the previous embodiments, except that a "b" designator has been added to all of the reference numerals used herein. Again, in general, unless otherwise indicated or recognized by those of ordinary skill in the art, the above-description also applies to the second arrangement.

With reference to FIG. 6, the seat duct 170*b* in the illustrated ventilation system has a first end 174*b* positioned proximate a lubricant reservoir or oil tank 134*b* and a second end 176*b* positioned within a recess beneath at least a portion of the seat (not shown). The oil tank 134*b* is mounted to an external surface of the engine 68*b* and is not formed as an oil pan in the illustrated engine 68*b*. The engine, thus, is considered a dry sump engine. To reduce the operating temperature of the lubricant being circulated in this arrangement, the cooler air pulled in through the seat duct 170*b* impinges upon the reservoir or oil tank 134*b* prior to circulating within the engine compartment. Moreover, the positioning of the outlet 174*b* makes advantageous use of the positioning of the induction system air intake (not shown). The air intake sucks air from within the engine compartment in increasing amounts as the engine speed increases. As is understood, the engine operating temperature also can increase as a result of higher speed engine operation. Accordingly, the induction system itself helps to pull increased amounts of cooler air into the engine compartment through the ducts formed through the hull as the engine speed increases.

Of course, the foregoing description is that of certain features, aspects and advantages of the present invention to which various changes and modifications may be made without departing from the spirit and scope of the present invention. For instance, various features of one ventilation arrangement can be easily modified for use with any of the other ventilation arrangements. Accordingly, swapping of various vent ducts between arrangements is fully contemplated. Moreover, a watercraft need not feature all objects of the present invention to use certain features, aspects and advantages of the present invention. The present invention, therefore, should only be defined by the appended claims.

What is claimed is:

1. A personal watercraft having a hull defiring an engine compartment, an internal combustion engine positioned in said engine compartment, a seat positioned above at least a portion of said engine, a pedestal supporting said seat, said watercraft including a water propulsion device, said engine having an output shaft arranged to power said water propulsion device, at least one pedestal air duct being disposed on a side wall of the pedestal and communicating with the engine compartment, said duct having a first end extending through said pedestal and a second end positioned within said engine compartment, said first end comprising a raised portion that extends outward from an exterior surface of said pedestal.

2. The watercraft of claim 1, wherein said engine includes an exhaust system, said exhaust system having an expanded portion, a catalyst being positioned within said expanded portion, said second end of said pedestal air duct being positioned proximate a side surface of said expanded portion.

3. The watercraft of claim 2 further comprising an exhaust system cover positioned over said expanded portion and between said expanded portion and said second end of said pedestal duct.

4. The watercraft of claim 3, wherein said cover extends only partially around the circumference of said expanded portion.

5. The watercraft of claim 1 further comprising at least one seat duct, said seat duct having a first end positioned within said engine compartment and a second end positioned in a recess defined beneath a portion of said seat.

6. The watercraft of claim 5, wherein said first end of said seat duct directs an airflow toward a portion of said exhaust system.

7. The watercraft of claim 6, wherein said portion of said exhaust system is said expanded portion.

8. The watercraft of claim 6, wherein said expanded portion is interposed between said first end of said seat duct and said second end of said pedestal duct.

9. The watercraft of claim 5, wherein said first end of said seat duct is positioned proximate a cylinder head of said engine.

10. The watercraft of claim 5, wherein said first end of said seat duct is positioned proximate a lubricant reservoir of said engine.

11. The watercraft of claim 10, wherein said lubricant reservoir is an oil pan.

12. The watercraft of claim 1, wherein said raised portion comprises a rearwardly facing opening.

13. A personal watercraft comprising a hull defining an engine compartment, an internal combustion engine being mounted within said engine compartment and having a crankshaft, a lubrication system being associated with said engine including a lubricant reservoir that is in fluid communication with at least a portion of said engine, a seat being removably attached to said hull and being positioned above at least a portion of said engine, an air chamber being formed beneath at least a portion of said seat, a ventilation duct extending between said air chamber and said engine compartment, said ventilation duct having an end disposed within said engine compartment proximate said lubricant reservoir, and said end oriented within the engine compartment to direct a flow of ventilating air across at least a portion of said lubricant reservoir.

14. The watercraft of claim 13, wherein said engine is a four-cycle engine and said lubricant reservoir is an oil pan.

15. The watercraft of claim 14, wherein said end of said ventilation duct is positioned at least partially lower than said crankshaft.

16. The watercraft of claim 13, wherein said engine is of the dry sump variety and said lubricant reservoir is external to said engine.

17. The watercraft of claim 16, wherein said engine is of the dry sump variety and said lubricant reservoir is external to said engine.

18. The watercraft of claim 13, wherein said end of said ventilation duct extends in a generally longitudinal direction.

19. The watercraft of claim 13, wherein said end of said ventilation duct extends in a direction generally parallel to a lower surface of said watercraft.

20. The watercraft of claim 13, wherein said end is oriented within said engine compartment to direct said flow of ventilating air toward a cylinder head of said engine.

21. The watercraft of claim 13, wherein said end is oriented within said engine compartment to direct said flow of ventilating air toward said lubricant reservoir.

22. A watercraft comprising a hull defining an engine compartment, a seat pedestal defining a generally vertical outer wall of said engine compartment, a seat disposed atop at least a portion of said seat pedestal, a steering actuator disposed forward of said seat, an engine positioned within said engine compartment and generally below said seat, said engine comprising a forward end, an air duct extending through said wall at a location rearward of said forward end of said engine.

23. The watercraft of claim 22 further comprising an exhaust system that is connected to said engine, said exhaust system comprising a catalyst and said air duct comprising an end that is disposed along a side of said exhaust system at a location generally aligned with said catalyst.

24. The watercraft of claim 22 further comprising a recess disposed beneath said seat and a second air duct that extends from said recess into said engine compartment at a location generally rearward of said engine.

25. The watercraft of claim 24, wherein said second air duct has a first end communicating with said recess and a second end disposed proximate a crankshaft of said engine.

26. The watercraft of claim 24, wherein said second air duct has a first end communicating with said recess and a second end disposed proximate said exhaust system.

27. The watercraft of claim 22, wherein said air duct comprises a protuberance formed on an outer surface of said wall.

28. The watercraft of claim 27, wherein said protuberance comprises a rearward facing opening.

29. The watercraft of claim 22, wherein said air duct comprises a rearwardly facing opening.

30. A watercraft comprising a hull defining an engine compartment, a seat pedestal defining an outer wall of said engine compartment, a seat disposed atop at least a portion of said seat pedestal, a recess defined beneath said seat, a steering actuator disposed forward of said seat, an engine positioned within said engine compartment and generally below said seat, said engine comprising a forward end, an air duct extending into said engine compartment at a location rearward of said forward end of said engine, an exhaust system containing a catalyst communicating with said engine, said air duct having an end disposed along a side surface of said exhaust system at a location generally corresponding to said catalyst.

31. The watercraft of claim 30, wherein said air duct extends through said pedestal.

32. The watercraft of claim 31, wherein said air duct comprises a protuberance formed on an outer surface of said pedestal.

33. The watercraft of claim 32, wherein said protuberance comprises a rearward facing opening.

34. The watercraft of claim 30, wherein said air duct comprises a rearwardly facing opening.

35. A watercraft comprising a hull defining an engine compartment, a seat pedestal defining an outer wall of said engine compartment, a seat disposed atop at least a portion of said seat pedestal, a recess defined beneath said seat, a steering actuator disposed forward of said seat, an engine positioned within said engine compartment and generally below said seat, said hull also defining an access opening positioned beneath said seat, an air duct extending into said engine compartment at a location rearward of a forward end of said access opening and forward of a rear end of said engine.

36. The watercraft of claim 35 further comprising an exhaust system containing a catalyst communicating with said engine, said air duct having an end disposed along a side surface of said exhaust system at a location generally corresponding to said catalyst.

37. The watercraft of claim 36 further comprising a recess disposed below said seat and separated from said access opening, a second air duct extending from said recess into said engine compartment at a location generally rearward of said engine.

38. The watercraft of claim 37, wherein said second air duct has a first end communicating with said recess and a second end disposed proximate a crankshaft of said engine.

39. The watercraft of claim 37, wherein said second air duct has a first end communicating with said recess and a second end disposed proximate said exhaust system.

40. The watercraft of claim 35, wherein said air duct comprises a protuberance formed on an outer surface of said pedestal.

41. The watercraft of claim 40, wherein said protuberance comprises a rearward facing opening.

42. The watercraft of claim 35, wherein said air duct comprises a rearwardly facing opening.

* * * * *